United States Patent [19]

Kim

[11] Patent Number: 4,779,302

[45] Date of Patent: Oct. 25, 1988

[54] DIPPER AND MIXER DRIVEWAY AND ROOF SPREADER BRUSH

[76] Inventor: Michael C. Kim, 3010 Hickory Mede, Ellicott City, Md. 21043

[21] Appl. No.: 140,654

[22] Filed: Jan. 4, 1988

[51] Int. Cl.[4] ..... A46B 11/04; B05C 17/00

[52] U.S. Cl. ..... 15/117; 15/105; 15/106; 15/257.2

[58] Field of Search ..... 15/105, 106, 117, 257.2; 401/137, 138, 139

[56] References Cited

U.S. PATENT DOCUMENTS

| | | | |
|---|---|---|---|
| 847,250 | 3/1907 | Gschwind | 15/117 |
| 2,243,607 | 5/1941 | Rosen et al. | 15/117 X |
| 2,290,178 | 7/1942 | Hayford | 15/111 |
| 3,995,345 | 12/1976 | Larsson | 15/117 X |
| 4,281,433 | 8/1981 | Sendoy Kas | 15/117 X |

*Primary Examiner*—Chris K. Moore

*Attorney, Agent, or Firm*—Walter G. Finch

[57] ABSTRACT

An elongate brush with handle forming a "T"-shape, has a plurality of cups along a top portion, all facing generally toward an end of the elongate brush so that with the elongate brush vertical it can be used for stirring asphalt-type compounds in buckets and for dipping out predeterminable quantities and spreading them, with or without use of a rubber spreader fixed parallel with the elongate brush. The plurality of cups can be made as a unit and need only cover about half the length of the elongate brush from the handle to the end opposite the end that they face. Inclined brush shape is disclosed to facilitate pouring.

10 Claims, 2 Drawing Sheets

DIPPER AND MIXER DRIVEWAY AND ROOF SPREADER BRUSH

FIELD OF THE INVENTION

This invention relates generally to brushes and particularly to brushes for driveway and roof surfacing materials.

BACKGROUND OF THE INVENTION

Spreading asphalt-type material on roofs and driveways usually involves pouring bulk quantities in various amounts and sloshing it in directions desired, making a mess and doing an uneven job in the process. The present invention, as an object, is provided for precise measurement and pouring at a distance to reduce such problems.

Push brushes are known including those that have a socket for handle attachment on each side of the brush head. U.S. Pat. No. 2,290,178 issued to C. F. Hayford on 7-21-42 discloses an example. However, as will be seen, this fortituous disclosure, although similar in structure, failed to suggest a practical device according to applicant's principle and use.

BRIEF SUMMARY OF THE INVENTION

In brief summary given as cursive description only and not as limitation, the invention includes a "T"-handle push brush with a spaced succession of ladles along one side. The ladles do not communicate with the bristles of the brush or with each other. In this preferred embodiment a scraper is additionally provided for use in spreading driveway or roofing material poured from the ladles. The proportions of the head are such that the brush is suited for use as a mixer for asphalt or other material in a bucket as well as a dipper and spreader of such material, regardless of whether the material is hot or cold, thick or water-consistency.

BRIEF DESCRIPTION OF THE DRAWINGS

The above and other objects and advantages of this invention will become more readily apparent on examination of the following description in which like reference characters refer to like parts.

DETAILED DESCRIPTION

Figure 1:
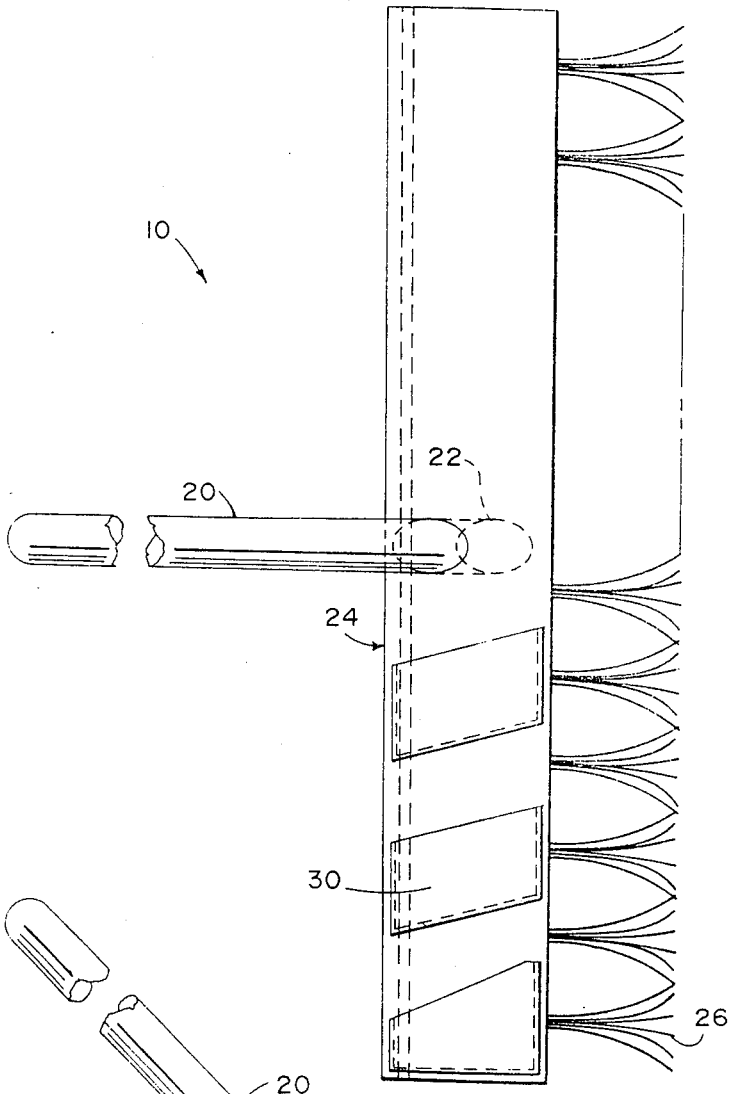
FIG. 1 is a fragmentary plan view of the preferred embodiment.
Figure 2:
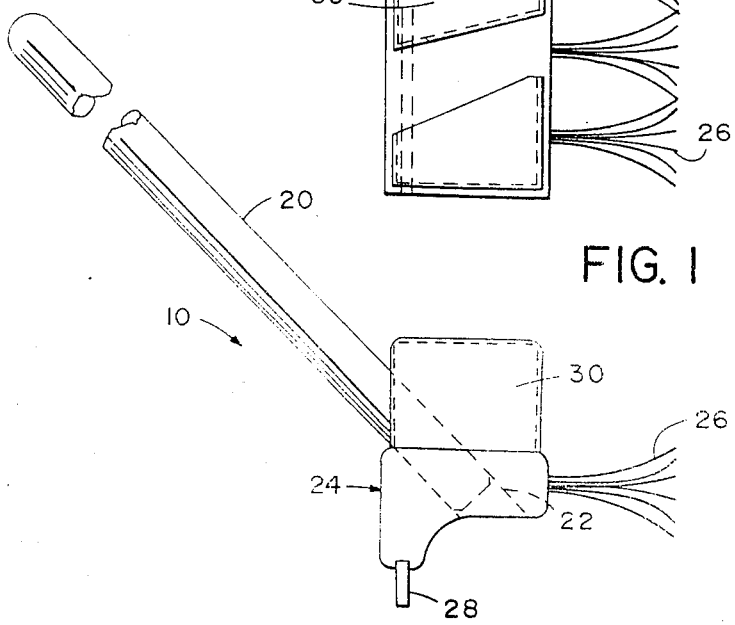
FIG. 2 is a fragmentary elevational view thereof.
Figure 3:
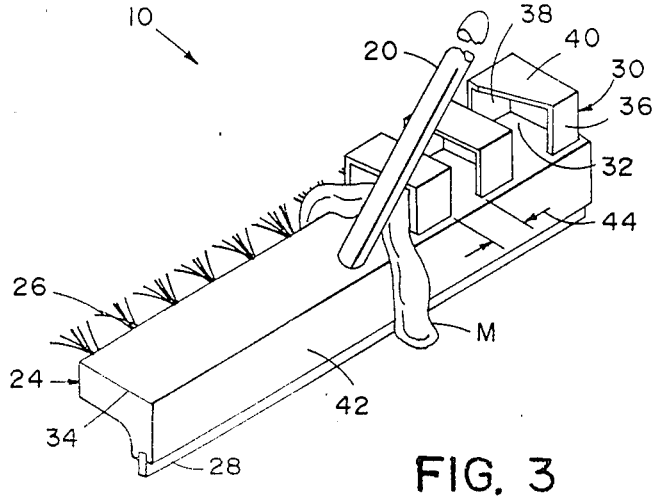
FIG. 3 is a fragmentary perspective view.

FIGS. 1, 2, and 3 show the preferred embodiment 10 as combining a handle 20 conventionally connected, as by fitting a socket 22 in an elongate brush head 24 forming a "T"-shaped brush-broom with a plurality of downwardly extending bristles 26 along the lower portion, the lower portion being that in the normal or usual brushing position. In this position the handle 20 extends obliquely upward and to the rear.

A scraper 28 of flexible material such as rubber extends horizontally forwardly in this position. Rotating the scraper on the brush head by 180° rotation of the handle 20 puts the scraper 28 into use-position pointing downwardly, in which case the bristles 26 are oriented horizontally. Extending along a top part or portion of the embodiment 10 in this orientation is a longitudinally-spaced succession of cups or ladles 30 used for dipping asphalt-type liquid from a bucket and distributing it over a driveway or roof surface to be treated or covered, using the relatively long handle as a rotatable length-adjustable boom to reach distant areas and pour out precise increments of material exactly where it can be spread and brushed using the scraper 28 and bristles 26.

The ladles 30 preferably are substantially all the same, each having an open face 32 (FIG. 3) facing a first end 34 of the brush head 24 and sides 36, 38 and top 40 forming a cup with the brush head upper portion. Each may hold about 1/10 to 2/5 liter, depending on desired size made, and the spacing 44 between successive cups may be made sufficient to permit free pouring for emptying them by rotating the handle. When in the position of FIG. 3, the material M pours out automatically, as shown.

Preferably the cups may be molded as a unit with the brush head, and may be in parallelogram form so that dipping is easier.

Figure 4A:
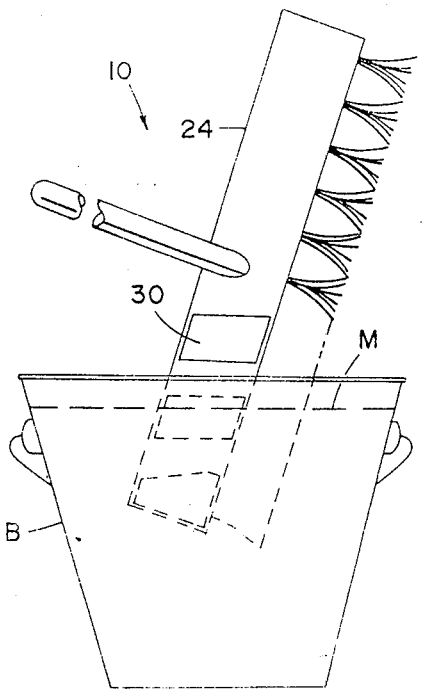
FIG. 4*a* is a fragmentary perspective view showing a first step in using the system.

FIG. 4*a* shows a customary first step in use of the embodiment 10, stirring asphalt-type liquid material M in a nominal-size bucket B. This may be a conventional five-gallon (20 liter) bucket. For stirring purposes the length of the brush head 24 is made substantially long enough to reach the bottom of the bucket, so that half the length from the handle to the end of the brush head, will reach the bottom of the bucket, with the brush head on an upright angle. Either half of the brush head may be used for stirring.

Next, the ladles are used to dip out a desired quantity of material. Three ladles 30 are shown; more or fewer may be provided, one or more may be used per dip, to supply the exact amount required regardless of whether the asphalt-type material is oil, hard tar, liquid tar, hot or cold, or even water, and regardless of condition to the surface treated.

Figure 4B:
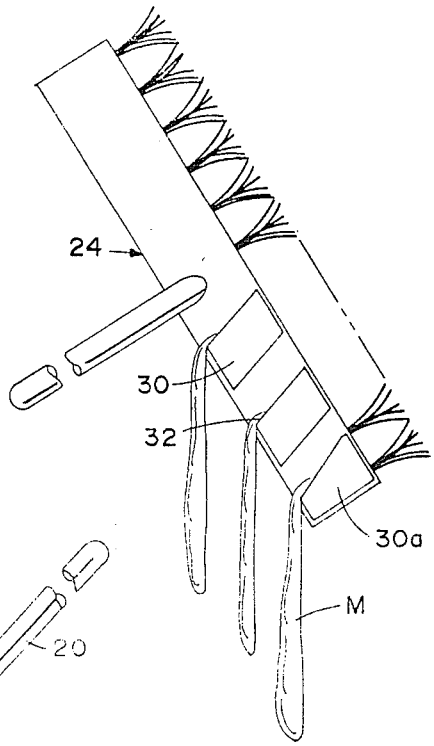
FIG. 4*b* is a fragmentary perspective view showing a second step in using the invention.

FIG. 4*b* shows the next step, pouring out the material M by rotating the brush head 24 in either direction, but from the lower side 32 of the parallelogram-shape ladles being preferred, as noted. Coming out at spaced locations as it does, this permits easier, more uniform spreading.

Figure 4C:
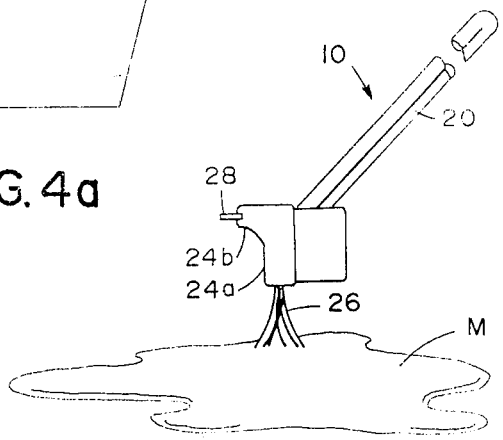
FIG. 4*c* is a fragmentary side elevational view of a third step in using this invention.

FIG. 4*c* shows a further step, spreading the material M on a surface, using the bristles 26 (or the scraper 28) as desired.

It will be appreciated that for lightness and strength, the brush head may be "L"-shaped in section with the bristles 26 projecting from one arm 24*a* of the "L"-shape and the scraper 28 from the other arm 24*b*, the handle 20 projecting generally from the apex of the "L"-shape.

Although the cups or ladles have been shown as angular, they may be round or any other shape.

The ladle 30*a* (FIG. 4*b*) at the second end of the brush head may be squared-off flat as indicated, for best clearance in a bucket and at a surface to be treated.

A nominal size bucket might be 12 inches (30 cm) deep and the brush head long enough to touch the bottom. Spacing of the ladles and the ladles themselves are shown generally in proportion. Although the brush head might have a succession of ladles on both ends, one end as shown is preferred. Advantageously, in the spreading attitude or orientation, the ladles will continue to pour out any viscous material in them.

It will be appreciated that in the FIG. 4*c* position the resilient scraper can act as a bumper and can define height.

Further, both scraper and bristles conveniently have the same angle with respect to the handle.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A system having means for mixing, dipping in predeterminable quantity from a bucket and spreading liquid asphaltic-type material on a surface to be protected, comprising a handle, a brush head fixed in "T"-relation thereto and having a plurality of bristles extending from the brush head along a lower part thereof, and a plurality of open end ladles fixed in spacing from each other along an upper part of said brush head whereby said material can be dipped by the plurality of ladles when the brush head is in a first orientation and can be discharged from the plurality of ladles when the brush head is in a second orientation.

2. A system as recited in claim 1, means facilitating use of the plurality of open-end ladles for dipping, comprising: said brush head having a first and a second end, and all said ladle open ends facing toward the first end of the brush head.

3. A system as recited in claim 2, means equipping the brush head for use in stirring said material in a nominal-sized bucket used for said material, comprising the brush head being substantially twice as long as the depth of said nominal size bucket, whereby a said end of the brush head can be inserted into said bucket of material and moved about, stirring said material.

4. A system as recited in claim 2, said plurality of open-end ladles being on the second end of the brush head.

5. A system as recited in claim 2, means facilitating use of said plurality of open-end ladles for pouring after dipping comprising: said plurality of open-end ladles having parallelogram-shape as viewed parallel with the handle.

6. A system as recited in claim 5, said parallelogram-shape providing for a part of each ladle to be lower than another part at said open face when the brush head is in the second orientation.

7. A system as recited in claim 1, said spacings being substantially equal.

8. A system as recited in claim 1, and a flexible scraper blade extending upwardly from the brush head substantially at right angles to said plurality of bristles.

9. A system as recited in claim 1, wherein the plurality of ladles is in position for pouring where said spreading is being done using said plurality of bristles.

10. A system as recited in claim 1, wherein said plurality of ladles is of unitary construction.

* * * * *